US005357681A

United States Patent [19]

Chen

[11] Patent Number: 5,357,681

[45] Date of Patent: Oct. 25, 1994

[54] GEAR SOCKET STRUCTURE FOR A DESIGNING RULE

[76] Inventor: Ming-Chieh Chen, No. 2-12. Chang Lu Rd., Chang-Hwa City, Taiwan

[21] Appl. No.: 192,643

[22] Filed: Feb. 7, 1994

[51] Int. Cl.[5] ..... B43L 11/00

[52] U.S. Cl. ..... 33/27.11; 33/562

[58] Field of Search ..... 33/27.01, 27.04, 27.05, 33/27.07, 27.08, 27.09, 27.1, 27.11, 30.1, 30.2, 30.3, 30.7, 562, 563, 565, 566, 18.1

[56] References Cited

U.S. PATENT DOCUMENTS 4,441,256 4/1984 Cummings et al. ..... 33/27.11

4,825,556 5/1989 Goldfarb ..... 33/27.11

*Primary Examiner*—William A. Cuchlinski, Jr.

*Assistant Examiner*—Alvin Wirthlin

*Attorney, Agent, or Firm*—W. Wayne Liauh

[57] ABSTRACT

A gear socket structure for a designing rule, of which the gear socket is a round cylinder, having a given height; the wall of the gear socket is provided with two leaf springs; the top of each leaf spring has an inward catch hook; the gear socket can accommodate a plurality of gears, which are held in place by means of the catch hooks without falling out unintentionally.

2 Claims, 3 Drawing Sheets

GEAR SOCKET STRUCTURE FOR A DESIGNING RULE

BACKGROUND OF THE INVENTION

As shown in FIG. 1, the conventional designing rule comprises a body "A", and a plurality of gears "B", "C" and "D" in different sizes . The gears are provided with an involute or other small round hole shapes "E", "F" and "G" respectively; from the center of each gear to the small round holes thereof, different distances are set respectively. The gears "B", "C" and "D" can be fitted in the large gear holes "H" and "I" respectively. When a pencil is set in one of small round holes "E", "F" and "G" of the gears "B" , "C" and "D", one of the gears "B", "C" and "D" may be turned within one of the large gear holes "H" and "I" to draw a given pattern. Various patterns can be drawn by using different gears "B", "C" and "D", different large gear holes "H" and "I", and different small round holes "E", "F" and "G".

However, the conventional designing rule has to be furnished with a given number of round sockets "J", "K" and "L" corresponding to that of gears "B", "C" and "D" in different sizes so as to accommodate the gears. Since the round sockets would take a considerable space and area on a rule, some gears would have no sockets to accommodate, if there are more gears to be used with such a designing rule; some of the gears might be missing because of no proper sockets available. Moreover, the round socket is merely used for accommodating a gear without holding the same in place; in other words, the gear in the round socket is subject to falling out, and causing inconvenience to a user.

SUMMARY OF THE INVENTION

This invention relates to a gear socket structure for a designing rule, which comprises a gear socket, being formed into a cylindrical shape and having a given height; the wall of the gear socket is provided with two leaf springs, of which each has an inward catch hook on the top thereof for holding gears in the gear socket. The prime object of the present invention is to provide a gear socket having a given height so as to receive a plurality of gears without providing more gear sockets in order to save space in the designing rule.

Another object of the present invention is to provide a gear socket with a resilient catching function to hold gears in place and to prevent gears in the gear socket from falling out.

DETAILED DESCRIPTION

Figure 1:
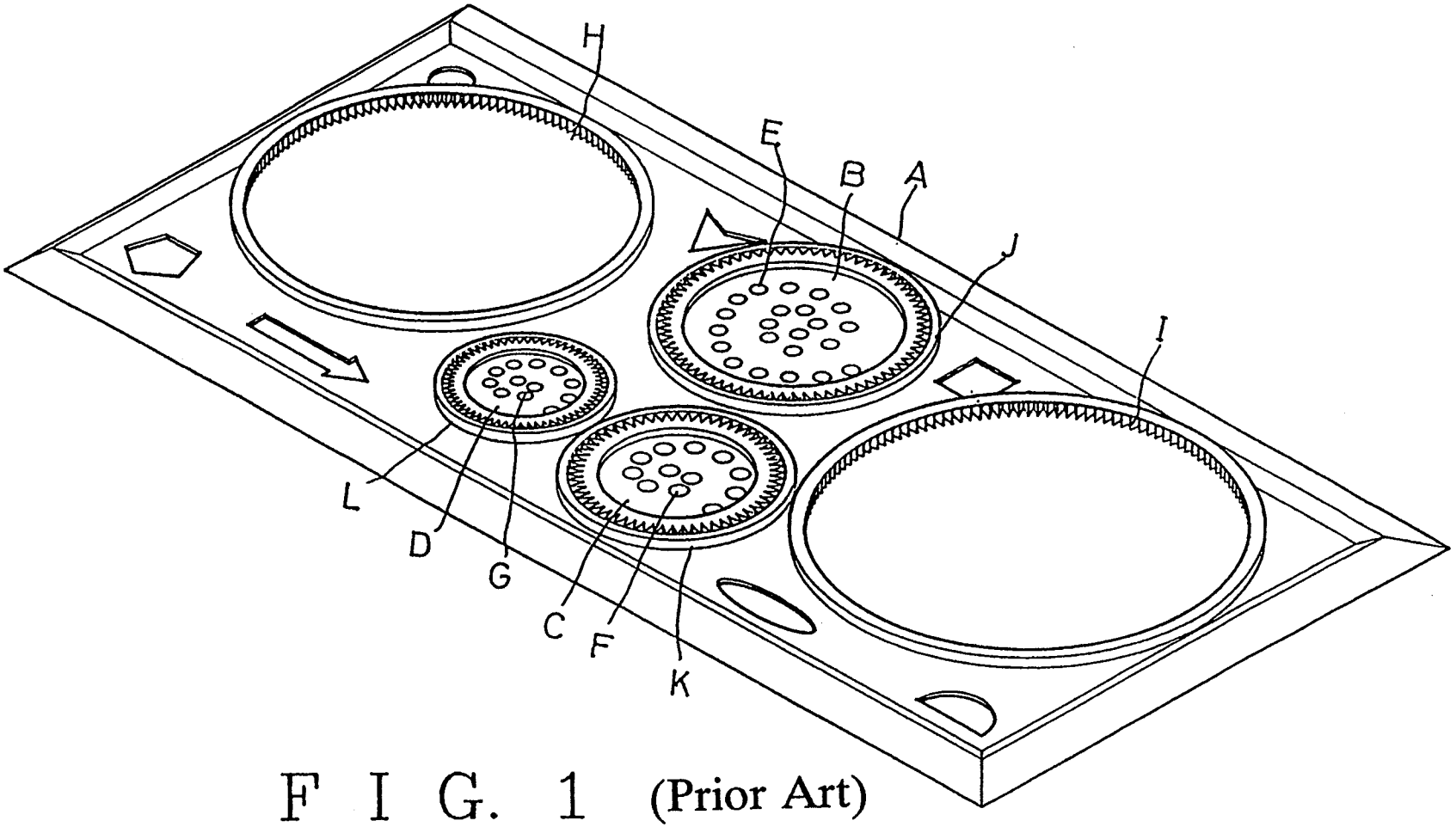
FIG. 1 (Prior Art)
FIG. 1 is a perspective view of a conventional designing rule.
Figure 2:
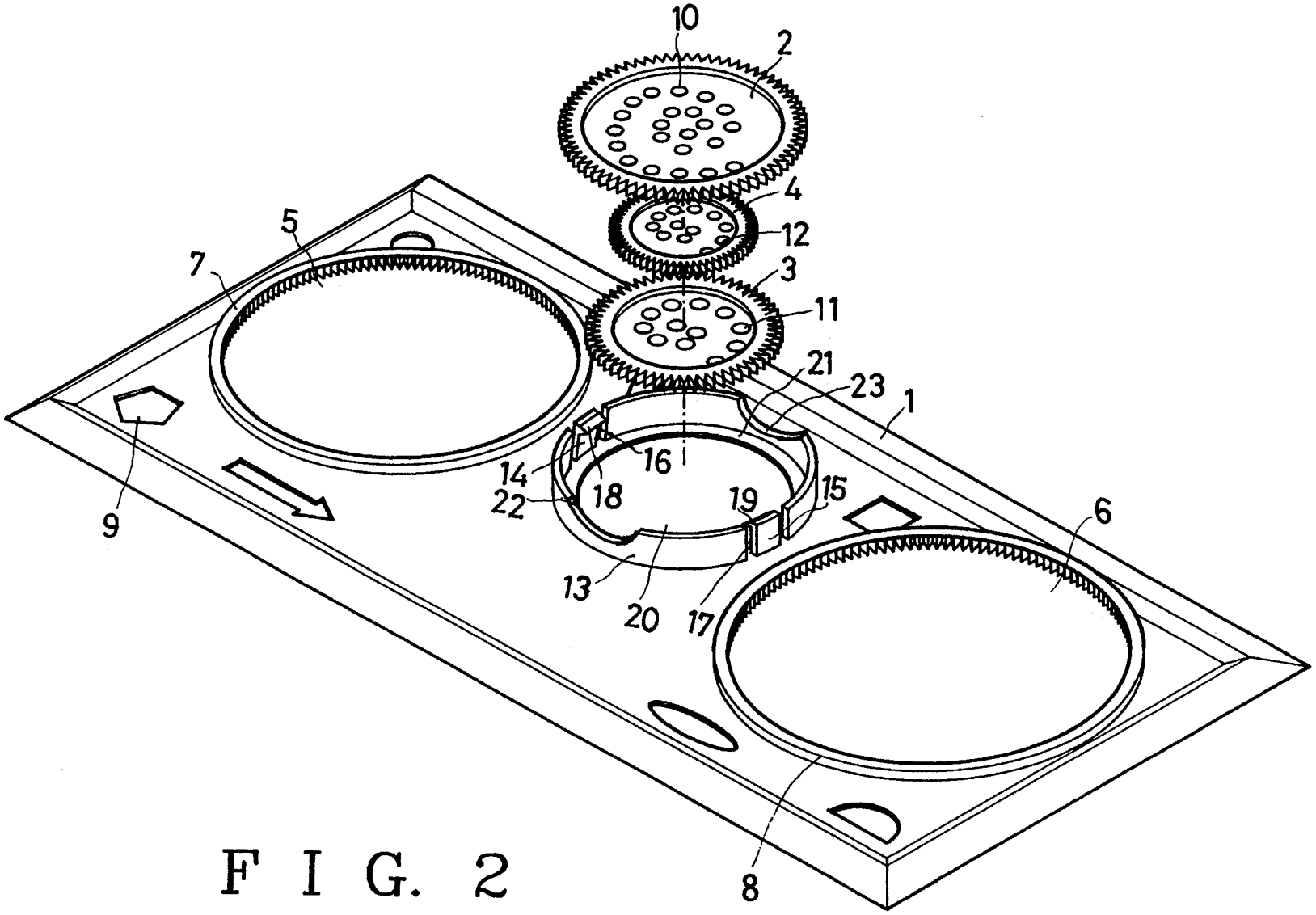
FIG. 2 is a perspective view of an embodiment according to the present invention.

Referring to FIG. 2, an embodiment of the present invention is shown with a perspective view; in fact, the designing rule according to the present invention is not limited to a given form. In order to facilitate description, the embodiment of the present invention is shown with a rectangular one, which comprises a body portion 1 and a plurality of gears 2, 3 and 4 in different sizes. The body portion 1 is a flat and rectangular member, of which the four sides are used as rulers. Both ends of the body portion 1 are provided with two large gear holes 5 and 6 in different sizes; both gear holes 5 and 6 have ring-shaped flanges 7 and 8 respectively to prevent gears 2, 3 and 4 put in the holes from moving out upon rotating therein. Along side portion of the body portion 1, a plurality of ready-made holes 9, such as a round hole, an arrow hole, square hole and a lozenge hole, etc., are provided so as to facilitate drawing such shapes immediately. The gears 2, 3 and 4 are provided with an involute or other small round-hole shapes 10, 11 and 12 respectively; various kinds of patterns can be drawn by means of such gears 2, 3 and 4, the large gear holes 5 and 6, and the small round-hole shapes 10, 11 and 12.

The major feature of the present invention is a gear socket 13 provided in the body portion 1; the gear socket 13 is substantially a hollow round cylinder, which has a height slightly more than that of several gears stacked up; the inner diameter of the gear socket 13 is slightly bigger than that of the largest gear so as to receive all the gears 2, 3 and 4 smoothly. The wall of the gear socket 13 is furnished with two opposite leaf springs 14 and 15 spaced at an equal angle. The lower ends of the two leaf springs 14 and 15 are connected together with the body portion 1; both sides of the two leaf springs are furnished with two opening slots 16 and 17 respectively so as to provide the leaf springs 14 and 15 with a given resilience. The upper ends of the leaf springs 14 and 15 are provided with inward catch hooks 18 and 19 respectively. The bottom of the gear socket 13 is an opening round hole 20 with a ring-shaped flange 21. The wall of the gear socket 13 has two curved kerfs 22 and 23.

Figure 3:
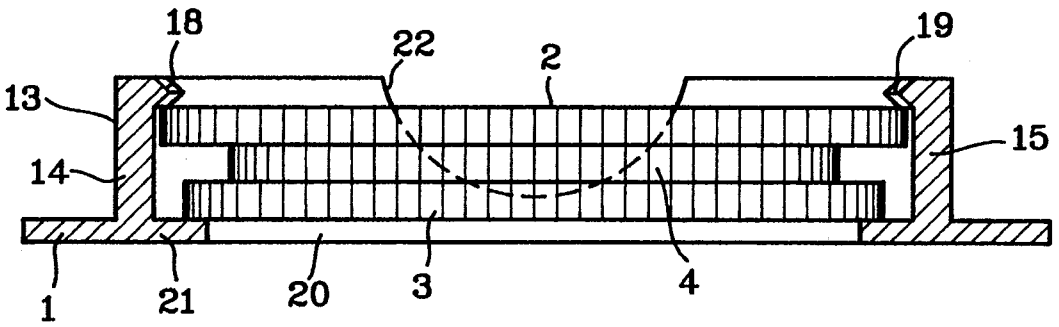
FIG. 3 is a sectional view the gear socket according to the present invention.

The gear socket 13 can accommodate several gears 2, 3 and 4 (as shown in FIG. 3). The ring-shaped flange 21 can prevent the gears from falling down through the round hole 20. Two catch hooks 18 and 19 on the leaf springs 14 and 15 respectively are used to hold the gears 2, 3 and 4 in the gear socket without moving out of the gear socket unintentionally. To take the gears 2, 3 and 4 out, a user may push the gears upwards, with a finger, through the bottom round hole 20 of the gear socket 13 with a slight pushing force to overcome the resilience of the leaf springs 14 and 15, while the fingers of another hand may hole the gears via the two curved kerfs 22 and 23.

I claim:

1. A gear socket structure for a designing rule, said designing rule having a body portion and at least one gear hole, a gear socket formed into a round cylinder on said body portion; said gear socket having a wall with a given height for accommodating a plurality of gears; means for holding said gears in said gear socket, said means including two leaf springs being provided on said wall of said gear socket, and each of said leaf springs having an inward catch hook on top thereof; a bottom of said gear socket having a round opening with a ring-shaped flange to support said gears.

2. A gear socket structure for a designing rule as claimed in claim 1, wherein said wall of said gear socket is provided with kerfs to facilitate fingers to pick up said gears.

* * * * *